US011898557B2

(12) United States Patent
Nicholas et al.

(10) Patent No.: US 11,898,557 B2
(45) Date of Patent: Feb. 13, 2024

(54) LIQUID COOLING OF A SCROLL TYPE COMPRESSOR WITH LIQUID SUPPLY THROUGH THE CRANKSHAFT

(71) Applicant: Air Squared, Inc., Broomfield, CO (US)

(72) Inventors: Nathan D. Nicholas, Westminster, CO (US); John P. D. Wilson, Lakewood, CO (US); Bryce R. Shaffer, Denver, CO (US)

(73) Assignee: Air Squared, Inc., Thornton, CO (US)

( * ) Notice: Subject to any disclaimer, the term of this patent is extended or adjusted under 35 U.S.C. 154(b) by 0 days.

(21) Appl. No.: 17/538,999

(22) Filed: Nov. 30, 2021

(65) Prior Publication Data

US 2022/0170462 A1 Jun. 2, 2022

Related U.S. Application Data

(60) Provisional application No. 63/119,399, filed on Nov. 30, 2020.

(51) Int. Cl.

| | |
|---|---|
| ***F04C 18/02*** | (2006.01) |
| ***F04C 27/00*** | (2006.01) |
| ***F04C 29/04*** | (2006.01) |
| *F04C 23/00* | (2006.01) |

(52) U.S. Cl.

CPC ..... *F04C 18/0215* (2013.01); *F04C 27/005* (2013.01); *F04C 27/009* (2013.01); *F04C 29/04* (2013.01); *F04C 23/008* (2013.01); *F04C 2240/603* (2013.01)

(58) Field of Classification Search

None

See application file for complete search history.

(56) References Cited

U.S. PATENT DOCUMENTS

| | | | |
|---|---|---|---|
| 801,182 | A | 10/1905 | Creux |
| 2,079,118 | A | 5/1937 | Hingst |
| 2,330,121 | A | 9/1943 | Heintz |
| 2,475,247 | A | 7/1949 | Mikulasek |

(Continued)

FOREIGN PATENT DOCUMENTS

| | | |
|---|---|---|
| CN | 1314899 | 5/2007 |
| CN | 103790826 | 5/2014 |

(Continued)

OTHER PUBLICATIONS

JP-60135691-A, English language machine translation (Year: 1985).*

(Continued)

*Primary Examiner* — Wesley G Harris

(74) *Attorney, Agent, or Firm* — Sheridan Ross P.C.

(57) ABSTRACT

Scroll devices with cooling fluid supplied through a crankshaft are provided. The device may comprise an orbiting scroll operably connected to a fixed scroll and a crankshaft operably connected to the orbiting scroll. A first seal may be positioned about an outer surface of the crankshaft to form a seal with the outer surface. A second seal may be positioned about an outer surface of the crankshaft to form a seal with the outer surface. A first channel and a second channel extend through the crankshaft and are in fluid communication with the orbiting scroll and a fluid source and a fluid reservoir.

20 Claims, 6 Drawing Sheets

(56) References Cited

U.S. PATENT DOCUMENTS 2,968,157 A 1/1961 Cronan
3,011,694 A 12/1961 Mulhouse et al.
3,262,573 A 7/1966 Schutte
3,470,704 A 10/1969 Kantor
3,600,114 A 8/1971 Miloslav et al.
3,613,368 A 10/1971 Doerner
3,802,809 A 4/1974 Vulliez
3,842,596 A 10/1974 Gray
3,874,827 A 4/1975 Young
3,884,599 A 5/1975 Young et al.
3,924,977 A 12/1975 McCullough
3,986,799 A 10/1976 McCullough
3,986,852 A 10/1976 Doerner et al.
3,994,633 A 11/1976 Shaffer
3,994,635 A 11/1976 McCullough
3,994,636 A 11/1976 McCullough et al.
3,999,400 A 12/1976 Gray
4,065,279 A 12/1977 McCullough
4,069,673 A 1/1978 Lapeyre
4,082,484 A 4/1978 McCullough
4,121,438 A 10/1978 McCullough
4,129,405 A 12/1978 McCullough
4,157,234 A 6/1979 Weaver et al.
4,160,629 A 7/1979 Hidden et al.
4,178,143 A 12/1979 Thelen et al.
4,192,152 A 3/1980 Armstrong et al.
4,199,308 A 4/1980 McCullough
4,216,661 A 8/1980 Tojo et al.
4,259,043 A 3/1981 Hidden et al.
4,300,875 A 11/1981 Fischer et al.
4,334,840 A 6/1982 Teruyama
4,340,339 A 7/1982 Hiraga et al.
4,368,802 A 1/1983 Grabill et al.
4,382,754 A 5/1983 Shaffer et al.
4,395,205 A 7/1983 McCullough
4,395,885 A 8/1983 Cozby
4,403,494 A 9/1983 McCullough
4,411,605 A 10/1983 Sauls
4,415,317 A 11/1983 Buttersworth
4,416,597 A 11/1983 Eber et al.
4,424,010 A 1/1984 McCullough
4,436,495 A 3/1984 McCullough
4,457,674 A 7/1984 Kawano et al.
4,462,771 A 7/1984 Teegarden
4,463,591 A 8/1984 McCullough
4,472,120 A 9/1984 McCullough
4,475,346 A 10/1984 Young et al.
4,477,238 A 10/1984 Terauchi
4,478,562 A 10/1984 Schippers et al.
4,511,091 A 4/1985 Vasco
4,512,066 A 4/1985 McCullough
4,515,539 A 5/1985 Etsuo
4,673,339 A 6/1987 Hayano et al.
4,718,836 A 1/1988 Pottier et al.
4,722,676 A 2/1988 Sugimoto
4,726,100 A 2/1988 Etemad et al.
4,730,375 A 3/1988 Nakamura et al.
4,732,550 A 3/1988 Suzuki et al.
4,756,675 A 7/1988 Kakuda et al.
4,802,831 A 2/1989 Suefuji et al.
4,832,586 A 5/1989 Emmenthal et al.
4,867,657 A 9/1989 Kotlarek et al.
4,875,839 A 10/1989 Sakata et al.
4,892,469 A 1/1990 McCullough et al.
4,911,621 A 3/1990 McCullough et al.
4,918,930 A 4/1990 Gaudet et al.
4,927,340 A 5/1990 McCullough
4,990,072 A 2/1991 Guttinger
5,013,226 A 5/1991 Nishida
5,037,280 A 8/1991 Nishida et al.
5,040,956 A 8/1991 Barito et al.
5,044,904 A 9/1991 Richardson, Jr.
5,051,075 A 9/1991 Young
5,051,079 A 9/1991 Richardson, Jr.
5,082,430 A 1/1992 Guttinger
5,099,658 A 3/1992 Utter et al.
5,108,274 A 4/1992 Kakuda et al.
5,127,809 A 7/1992 Amata et al.
5,142,885 A 9/1992 Utter et al.
5,149,255 A 9/1992 Young
5,157,928 A 10/1992 Gaudet et al.
5,160,253 A 11/1992 Okada et al.
5,176,004 A 1/1993 Gaudet
5,214,932 A 6/1993 Abdelmalek
5,217,360 A 6/1993 Kawahara et al.
5,222,882 A 6/1993 McCullough
5,224,849 A 7/1993 Forni
5,228,309 A 7/1993 McCullough
5,232,355 A 8/1993 Fujii et al.
5,242,284 A 9/1993 Mitsunaga et al.
5,247,795 A 9/1993 McCullough
RE34,413 E 10/1993 McCullough
5,256,042 A 10/1993 McCullough et al.
5,258,046 A 11/1993 Haga et al.
5,265,431 A 11/1993 Gaudet et al.
5,286,179 A 2/1994 Forni et al.
5,295,808 A 3/1994 Machida et al.
5,314,316 A 5/1994 Shibamoto et al.
5,328,341 A 7/1994 Forni
5,338,159 A 8/1994 Riffe et al.
5,343,708 A 9/1994 Gaudet et al.
5,354,184 A 10/1994 Forni
5,358,387 A 10/1994 Suzuki et al.
5,397,223 A * 3/1995 Spinnler ..... F01C 1/0223 184/5
5,417,554 A 5/1995 Kietzman et al.
5,443,368 A 8/1995 Weeks et al.
5,449,279 A 9/1995 Hill et al.
5,450,316 A 9/1995 Gaudet et al.
5,462,419 A 10/1995 Hill et al.
5,466,134 A 11/1995 Shaffer et al.
5,496,161 A 3/1996 Machida et al.
5,609,478 A 3/1997 Utter et al.
5,616,015 A 4/1997 Liepert
5,616,016 A 4/1997 Hill et al.
5,632,612 A 5/1997 Shaffer
5,632,613 A 5/1997 Shin et al.
5,637,942 A 6/1997 Forni
5,640,854 A 6/1997 Fogt et al.
5,720,602 A 2/1998 Hill et al.
5,746,719 A 5/1998 Ferra et al.
5,752,816 A 5/1998 Shaffer
5,759,020 A 6/1998 Shaffer
5,800,140 A 9/1998 Forni
5,803,723 A 9/1998 Suefuji et al.
5,836,752 A 11/1998 Calhoun et al.
5,842,843 A 12/1998 Haga
5,855,473 A 1/1999 Liepert
5,857,844 A 1/1999 Lifson et al.
5,873,711 A 2/1999 Lifson
5,938,419 A 8/1999 Honma et al.
5,951,268 A 9/1999 Pottier et al.
5,961,297 A 10/1999 Haga et al.
5,987,894 A 11/1999 Claudet
6,008,557 A 12/1999 Dornhoefer et al.
6,022,195 A 2/2000 Gaudet et al.
6,050,792 A 4/2000 Shaffer
6,068,459 A 5/2000 Clarke et al.
6,074,185 A 6/2000 Protos
6,098,048 A 8/2000 Dashefsky et al.
6,129,530 A 10/2000 Shaffer
6,179,590 B1 1/2001 Honma et al.
6,186,755 B1 2/2001 Haga
6,190,145 B1 2/2001 Fujioka et al.
6,193,487 B1 2/2001 Ni
6,213,970 B1 4/2001 Nelson et al.
6,283,737 B1 9/2001 Kazikis et al.
6,318,093 B2 11/2001 Gaudet et al.
6,328,545 B1 * 12/2001 Kazakis ..... F04C 18/0215 418/94
6,379,134 B2 4/2002 Iizuka
6,434,943 B1 8/2002 Garris
6,439,864 B1 8/2002 Shaffer
6,460,351 B2 10/2002 Gaudet et al.

(56) References Cited

U.S. PATENT DOCUMENTS

| | | | |
|---|---|---|---|
| 6,461,113 | B1 | 10/2002 | Gaudet et al. |
| 6,464,467 | B2 | 10/2002 | Sullivan et al. |
| 6,511,308 | B2 | 1/2003 | Shaffer |
| 6,623,445 | B1 | 9/2003 | Nelson et al. |
| 6,644,946 | B2 | 11/2003 | Nakane et al. |
| 6,663,364 | B2 | 12/2003 | Okada et al. |
| 6,712,589 | B2 | 3/2004 | Mori et al. |
| 6,736,622 | B1 | 5/2004 | Bush et al. |
| 6,755,028 | B2 | 6/2004 | Gaudet et al. |
| 6,902,378 | B2 | 6/2005 | Gaudet et al. |
| 6,905,320 | B2 | 6/2005 | Satoh et al. |
| 6,922,999 | B2 | 8/2005 | Kimura et al. |
| 7,111,467 | B2 | 9/2006 | Apparao et al. |
| 7,124,585 | B2 | 10/2006 | Kim et al. |
| 7,144,383 | B2 | 12/2006 | Arnett et al. |
| 7,181,928 | B2 | 2/2007 | de Larminat |
| 7,201,568 | B2 | 4/2007 | Sakamoto et al. |
| 7,234,310 | B2 | 6/2007 | Flynn et al. |
| 7,249,459 | B2 | 7/2007 | Hisanaga et al. |
| 7,297,133 | B2 | 11/2007 | Nelson et al. |
| 7,306,439 | B2 | 12/2007 | Unami et al. |
| 7,314,358 | B2 | 1/2008 | Tsuchiya |
| 7,329,108 | B2 | 2/2008 | Tscuchiya et al. |
| 7,439,702 | B2 | 10/2008 | Smith et al. |
| 7,458,152 | B2 | 12/2008 | Sato |
| 7,458,414 | B2 | 12/2008 | Simon |
| 7,836,696 | B2 | 11/2010 | Uno et al. |
| 7,861,541 | B2 | 1/2011 | Dieckmann et al. |
| 7,906,016 | B2 | 3/2011 | Weber et al. |
| 7,942,655 | B2 | 5/2011 | Shaffer |
| 7,980,078 | B2 | 7/2011 | McCutchen et al. |
| 8,007,260 | B2 | 8/2011 | Yanagisawa |
| 8,087,260 | B2 | 1/2012 | Ogata et al. |
| 8,186,980 | B2 | 5/2012 | Komai et al. |
| 8,328,544 | B2 | 12/2012 | Iwano et al. |
| 8,484,974 | B1 | 7/2013 | Monson et al. |
| 8,523,544 | B2 | 9/2013 | Shaffer |
| 8,668,479 | B2 | 3/2014 | Shaffer |
| 8,674,525 | B2 | 3/2014 | Van Den Bossche et al. |
| 8,858,203 | B2 | 10/2014 | Kanizumi et al. |
| 9,022,758 | B2 | 5/2015 | Roof et al. |
| 9,028,230 | B2 | 5/2015 | Shaffer |
| 9,074,598 | B2 | 7/2015 | Shaffer et al. |
| 9,115,719 | B2 | 8/2015 | Sadakata et al. |
| 9,657,733 | B2 | 5/2017 | Chadwick et al. |
| 9,784,139 | B2 | 10/2017 | Shaffer et al. |
| 9,885,358 | B2 | 2/2018 | Shaffer |
| 10,221,852 | B2 | 3/2019 | Shaffer et al. |
| 10,400,771 | B2 | 9/2019 | Valdez et al. |
| 10,508,543 | B2 | 12/2019 | Shaffer |
| 10,519,815 | B2 | 12/2019 | Shaffer et al. |
| 10,683,865 | B2 | 6/2020 | Shaffer et al. |
| 10,774,690 | B2 | 9/2020 | Shaffer et al. |
| 10,865,793 | B2 | 12/2020 | Shaffer et al. |
| 10,890,187 | B2 | 1/2021 | Fukuhara et al. |
| 11,047,389 | B2 | 6/2021 | Shaffer et al. |
| 11,067,080 | B2 | 7/2021 | Mesward et al. |
| 2001/0012485 | A1 | 8/2001 | Gaudet et al. |
| 2001/0038800 | A1 | 11/2001 | Kimura et al. |
| 2001/0043878 | A1 | 11/2001 | Sullivan et al. |
| 2002/0011332 | A1 | 1/2002 | Oh et al. |
| 2002/0039534 | A1 | 4/2002 | Moroi et al. |
| 2002/0071779 | A1 | 6/2002 | Moroi et al. |
| 2002/0094277 | A1 | 7/2002 | Gaudet et al. |
| 2002/0104320 | A1 | 8/2002 | Gaudet et al. |
| 2003/0017070 | A1 | 1/2003 | Moroi et al. |
| 2003/0026721 | A1 | 2/2003 | Moroi et al. |
| 2003/0051487 | A1 | 3/2003 | Gaudet et al. |
| 2003/0053922 | A1 | 3/2003 | Satoh et al. |
| 2003/0138339 | A1 | 7/2003 | Scancarello |
| 2003/0223898 | A1 | 12/2003 | Fujioka et al. |
| 2004/0020206 | A1 | 2/2004 | Sullivan et al. |
| 2004/0184940 | A1 | 9/2004 | Nakane et al. |
| 2004/0194477 | A1 | 10/2004 | Gaudet et al. |
| 2004/0241030 | A1 | 12/2004 | Matsushima |
| 2004/0255591 | A1 | 12/2004 | Hisanga et al. |
| 2005/0025651 | A1 | 2/2005 | Sowa et al. |
| 2005/0031469 | A1 | 2/2005 | Yanagisawa et al. |
| 2005/0081536 | A1 | 4/2005 | Gaudet et al. |
| 2005/0169788 | A1 | 8/2005 | Komai et al. |
| 2005/0196284 | A1 | 9/2005 | Gaudet et al. |
| 2005/0220649 | A1 | 10/2005 | Sato |
| 2006/0016184 | A1 | 1/2006 | Simon |
| 2006/0045760 | A1 | 3/2006 | Haller et al. |
| 2006/0045783 | A1 | 3/2006 | Yanagisawa et al. |
| 2006/0130495 | A1 | 6/2006 | Dieckmann et al. |
| 2006/0216180 | A1 | 9/2006 | Yanagisawa et al. |
| 2007/0071626 | A1 | 3/2007 | Tsuchiya et al. |
| 2007/0098511 | A1 | 5/2007 | Kikkawa et al. |
| 2007/0104602 | A1 | 5/2007 | Ishikawa et al. |
| 2007/0108934 | A1 | 5/2007 | Smith et al. |
| 2007/0172373 | A1 | 7/2007 | Ni |
| 2007/0231174 | A1 | 10/2007 | Ishizuki |
| 2007/0269327 | A1 | 11/2007 | Qian |
| 2008/0159888 | A1 | 7/2008 | Nakayama et al. |
| 2008/0193311 | A1 | 8/2008 | Helies |
| 2008/0206083 | A1 | 8/2008 | Suefuji et al. |
| 2009/0148327 | A1 | 6/2009 | Carter et al. |
| 2009/0246055 | A1 | 10/2009 | Stehouwer et al. |
| 2009/0304536 | A1 | 12/2009 | Egawa et al. |
| 2010/0044320 | A1 | 2/2010 | Weber et al. |
| 2010/0111740 | A1 | 5/2010 | Ni |
| 2010/0254835 | A1 | 10/2010 | Kane et al. |
| 2010/0287954 | A1 | 11/2010 | Harman et al. |
| 2011/0129362 | A1 | 6/2011 | Kameya et al. |
| 2012/0134862 | A1 | 5/2012 | Hockliffe et al. |
| 2012/0240847 | A1 | 9/2012 | Neufelder et al. |
| 2013/0149179 | A1 | 6/2013 | Sato et al. |
| 2013/0207396 | A1 | 8/2013 | Tsuboi |
| 2013/0232975 | A1 | 9/2013 | Shaffer et al. |
| 2014/0023540 | A1 | 1/2014 | Heidecker et al. |
| 2014/0260364 | A1 | 9/2014 | Litch |
| 2017/0045046 | A1 | 2/2017 | Afshari |
| 2017/0067469 | A1 | 3/2017 | Malvasi et al. |
| 2017/0074265 | A1 | 3/2017 | Asami et al. |
| 2017/0284284 | A1 | 10/2017 | Takamiya |
| 2017/0306956 | A1 | 10/2017 | Monet |
| 2017/0321699 | A1 | 11/2017 | Kawano et al. |
| 2019/0277289 | A1 | 9/2019 | Yoo et al. |
| 2019/0293070 | A1 | 9/2019 | Crum et al. |
| 2019/0338779 | A1* | 11/2019 | Shaffer ..... F01C 1/0223 |
| 2019/0353162 | A1 | 11/2019 | Ishii et al. |
| 2020/0025199 | A1 | 1/2020 | Wilson et al. |
| 2020/0025204 | A1 | 1/2020 | Nicholas et al. |
| 2020/0040892 | A1 | 2/2020 | Dieckmann et al. |
| 2020/0063735 | A1 | 2/2020 | Yamashita et al. |
| 2020/0408201 | A1 | 12/2020 | Wilson et al. |
| 2021/0071669 | A1 | 3/2021 | Shaffer et al. |

FOREIGN PATENT DOCUMENTS

| | | | |
|---|---|---|---|
| CN | 104235018 | 12/2014 | |
| CN | 104632636 | 5/2015 | |
| CN | 105402134 | 3/2016 | |
| CN | 111765078 | 10/2020 | |
| DE | 460936 | 6/1928 | |
| DE | 19957425 | 8/2000 | |
| EP | 341408 A * | 11/1989 | ..... F04C 29/023 |
| EP | 0513824 | 11/1992 | |
| EP | 0780576 | 6/1997 | |
| EP | 1464838 | 10/2004 | |
| EP | 3239526 | 11/2017 | |
| GB | 0513827 | 10/1939 | |
| GB | 2002455 | 2/1979 | |
| GB | 1575684 | 9/1980 | |
| JP | S56-019369 | 2/1981 | |
| JP | S57-171002 | 10/1982 | |
| JP | 60135691 A * | 7/1985 | ..... F04C 29/04 |
| JP | S63-173870 | 7/1988 | |
| JP | H02-275083 | 11/1990 | |
| JP | H03-185287 | 8/1991 | |
| JP | H05-157076 | 6/1993 | |
| JP | H07-109981 | 4/1995 | |
| JP | H07-324688 | 12/1995 | |

(56) References Cited

FOREIGN PATENT DOCUMENTS

| | | | | |
|---|---|---|---|---|
| JP | H08-261182 | | 10/1996 | |
| JP | 2000-213475 | | 8/2000 | |
| JP | 2002-13493 | | 1/2002 | |
| JP | 2002-227779 | | 8/2002 | |
| JP | 2003-343459 | | 12/2003 | |
| JP | 2011-012629 | | 1/2011 | |
| WO | WO 2004/008829 | | 1/2004 | |
| WO | WO 2009/050126 | | 4/2009 | |
| WO | WO 2013/121900 | | 8/2013 | |
| WO | WO-2015022869 | A1 * | 2/2015 | ..... F04C 18/0215 |
| WO | WO 2015/164453 | | 10/2015 | |
| WO | WO-2016093361 | A1 * | 6/2016 | ..... F04B 39/02 |
| WO | WO 2017/089745 | | 6/2017 | |
| WO | WO-2021005895 | A1 * | 1/2021 | ..... F04C 18/0215 |

OTHER PUBLICATIONS

U.S. Appl. No. 16/275,943, filed Feb. 14, 2019 now U.S. Pat. No. 11,067,080.
U.S. Appl. No. 13/507,779, filed Jul. 30, 2012 now U.S. Pat. No. 9,074,598.
U.S. Appl. No. 13/986,349, filed Apr. 23, 2013.
U.S. Appl. No. 14/756,594, filed Sep. 22, 2015 now U.S. Pat. No. 9,784,139.
U.S. Appl. No. 15/731,929, filed Aug. 24, 2017 now U.S. Pat. No. 10,519,815.
U.S. Appl. No. 15/932,150, filed Feb. 12, 2018 now U.S. Pat. No. 10,774,690.
U.S. Appl. No. 14/999,427, filed May 4, 2016 now U.S. Pat. No. 10,221,852.
U.S. Appl. No. 16/291,984, filed Mar. 4, 2019 now U.S. Pat. No. 11,047,389.
U.S. Appl. No. 15/731,324, filed May 25, 2017 now U.S. Pat. No. 10,508,543.
U.S. Appl. No. 15/732,593, filed Nov. 30, 2017 now U.S. Pat. No. 10,865,793.
U.S. Appl. No. 16/950,690, filed Nov. 17, 2020.
U.S. Appl. No. 16/514,639, filed Jul. 17, 2019.
U.S. Appl. No. 15/373,979, filed Dec. 9, 2016 now U.S. Pat. No. 10,400,771.
U.S. Appl. No. 16/912,537, filed Jun. 25, 2020.
U.S. Appl. No. 17/679,936, filed Feb. 24, 2022.
U.S. Appl. No. 16/400,921, filed May 1, 2019.
U.S. Appl. No. 16/213,111, filed Dec. 7, 2018.
U.S. Appl. No. 09/161,629, filed Sep. 28, 1998 now U.S. Pat. No. 6,129,530.
U.S. Appl. No. 09/715,726, filed Nov. 20, 2000 now U.S. Pat. No. 6,439,864.
U.S. Appl. No. 09/751,057, filed Jan. 2, 2001 now U.S. Pat. No. 6,511,308.
U.S. Appl. No. 09/228,485, filed Jan. 11, 1999 now U.S. Pat. No. 6,050,792.
U.S. Appl. No. 11/703,585, filed Feb. 6, 2007 now U.S. Pat. No. 7,942,655.
U.S. Appl. No. 12/930,140, filed Dec. 29, 2010 now U.S. Pat. No. 8,668,479.
U.S. Appl. No. 13/066,261, filed Apr. 11, 2011 now U.S. Pat. No. 8,523,544.
U.S. Appl. No. 13/987,486, filed Jul. 30, 2013 now U.S. Pat. No. 9,028,230.
U.S. Appl. No. 14/544,874, filed Feb. 27, 2015 now U.S. Pat. No. 9,885,358.
U.S. Appl. No. 15/330,223, filed Aug. 26, 2016 now U.S. Pat. No. 10,683,865.
"Digital Scroll Compressor Technology," Wikipedia, 2010, 3 pages [retrieved online from: en.wikipedia.org/wiki/Digital_Scroll_Compressor_Technology].
"Heat Pump and Refrigeration Cycle," Wikipedia, last updated May 10, 2013, 4 pages [retrieved online from: en.wikipedia.org/wiki/Heat_pump_and_refrigeration_cycle].
"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Operating Manual: OM WGZC-2 Water-Cooled Scroll Compressor Chillers," McQuay International, 2010, 102 pages.
"Organic Rankine Cycle," Wikipedia, last modified May 19, 2013, 4 pages [retrieved online from: en.wikipedia.org/wiki/Organic_Rankine_Cycle].
"R410A // Hermetic Scroll Compressors," Bitzer, 2016, 12 pages.
"Rankine Cycle," Wikipedia, last modified Apr. 29, 2013, 4 pages [retrieved online from: en.wikipedia.org/wiki/Rankine_cycle].
"Refrigeration Technologies: scroll-compressor chillers," Misto, last modified Jan. 2013, 7 pages.
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for International (PCT) Patent Application No. PCT/US2018/064427, dated Feb. 5, 2019 14 pages.
International Preliminary Report on Patentability for International (PCT) Patent Application No. PCT/US2018/064427, dated Nov. 19, 2020 8 pages.
Office Action (English Translation) for China Patent Application No. 201980029887.8, dated Dec. 3, 2021 10 pages.
Notice of Allowance with English Translation for China Patent Application No. 201980029887.8, dated Jun. 28, 2022 6 pages.
Extended European Search Report for European Patent Application No. 18917539.1, dated Jan. 4, 2022 7 pages.
Official Action with English Translation for Japan Patent Application No. 2020-561761, dated Sep. 21, 2021 6 pages.
Decision to Grant for Japan Patent Application No. 2020-561761, dated Feb. 15, 2022 6 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
International Preliminary Report on Patentability for International (PCT) Patent Application No. PCT/US18/00118, dated Jun. 11, 2020 13 pages.
Official Action with English Translation for China Patent Application No. 201880077598.0, dated Aug. 12, 2021 13 pages.
Notice of Allowance with English Translation for China Patent Application No. 201880077598.0, dated Feb. 18, 2022 6 pages.
Extended European Search Report for European Patent Application No. 18883031.9, dated May 3, 2021 6 pages.
Official Action with English Translation for Japan Patent Application No. 2020-548856, dated Jun. 29, 2021 10 pages.
Notice of Allowance with English Translation for Japan Patent Application No. 2020-548856, dated Nov. 2, 2021 5 pages.
Official Action for U.S. Appl. No. 16/275,943, dated Oct. 9, 2020 15 pages.
Notice of Allowance for U.S. Appl. No. 16/275,943, dated Mar. 22, 2021 12 pages.
Official Action for U.S. Appl. No. 16/514,639, dated Apr. 12, 2021 6 pages Restriction Requirement.
Official Action for U.S. Appl. No. 16/514,639, dated Jun. 9, 2021 11 pages.

(56) References Cited

OTHER PUBLICATIONS

Official Action for U.S. Appl. No. 16/514,639, dated Nov. 9, 2021 12 pages.
Official Action for U.S. Appl. No. 16/514,639, dated Mar. 4, 2022 26 pages.
Official Action for U.S. Appl. No. 16/514,639, dated Jun. 23, 2022 26 pages.
Official Action for U.S. Appl. No. 16/400,921, dated Jun. 4, 2021 7 pages Restriciton Requirement.
Official Action for U.S. Appl. No. 16/400,921, dated Nov. 19, 2021 24 pages.
Official Action for U.S. Appl. No. 16/400,921, dated Apr. 26, 2022 21 pages.
Official Action for U.S. Appl. No. 16/213,111, dated Sep. 30, 2020 22 pages.
Official Action for U.S. Appl. No. 16/213,111, dated May 4, 2021 25 pages.
Official Action for U.S. Appl. No. 16/213,111, dated Dec. 8, 2021 23 pages.
Notice of Allowance for U.S. Appl. No. 16/213,111, dated Apr. 26, 2022 10 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriciton Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 15/544,874, dated Jan. 26, 2017 9 pages.
Official Action for U.S. Appl. No. 15/544,874, dated Jul. 21, 2017 6 pages.
Notice of Allowance for U.S. Appl. No. 14/544,874, dated Sep. 28, 2017 5 pages.
Official Action for U.S. Appl. No. 15/330,223, dated Nov. 15, 2017 6 pages Restriciton Requirement.
Official Action for U.S. Appl. No. 15/330,223, dated Feb. 7, 2018 10 pages.
Official Action for U.S. Appl. No. 15/330,223, dated Apr. 7, 2018 10 pages.
Official Action for U.S. Appl. No. 15/330,223, dated Jan. 11, 2019 14 pages.
Notice of Allowance for U.S. Appl. No. 15/330,223, dated Jan. 23, 2020 10 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/759,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 15/731,929, dated Jun. 4, 2019 10 pages.
Notice of Allowance for U.S. Appl. No. 15/731,929, dated Aug. 14, 2019 9 pages.
Official Action for U.S. Appl. No. 15/932,150, dated Nov. 25, 2019 26 pages.
Official Action for U.S. Appl. No. 15/932,150, dated Mar. 5, 2020 19 pages.
Notice of Allowance for U.S. Appl. No. 15/932,150, dated May 14, 2020 9 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 16/291,984, dated Oct. 26, 2020 12 pages.
Notice of Allowance for U.S. Appl. No. 16/291,984, dated Feb. 26, 2021 13 pages.
Official Action for U.S. Appl. No. 15/731,324, dated Feb. 7, 2019 15 pages.
Notice of Allowance for U.S. Appl. No. 15/731,324, dated Aug. 2, 2019 11 pages.
Official Action for U.S. Appl. No. 15/732,593, dated Nov. 14, 2019 7 pages Restriction Requirement.
Official Action for U.S. Appl. No. 15/732,593, dated Feb. 19, 2020 13 pages.
Notice of Allowance for U.S. Appl. No. 15/732,593, dated Aug. 13, 2020 9 pages.
Official Action for U.S. Appl. No. 16/950,690, dated Jan. 6, 2022 7 pages Restricition Requirement.
Official Action for U.S. Appl. No. 16/950,690, dated Mar. 17, 2022 16 pages.
Official Action for U.S. Appl. No. 15/373,979, dated Jan. 29, 2019 12 pages.
Notice of Allowance for U.S. Appl. No. 15/373,979, dated Apr. 26, 2019 9 pages.
Official Action for U.S. Appl. No. 16/912,537, dated Nov. 19, 2021 24 pages.
Notice of Allowance for U.S. Appl. No. 16/912,537, dated May 25, 2022 8 pages.
Notice of Allowance for U.S. Appl. No. 16/400,921, dated Aug. 18, 2022 9 pages.
Official Action for U.S. Appl. No. 16/950,690, dated Sep. 9, 2022 9 pages.
Official Action for U.S. Appl. No. 17/679,936, dated Oct. 27, 2022 16 pages.
Official Action for U.S. Appl. No. 17/972,165, dated Mar. 15, 2023 18 pages.
Notice of Allowance for U.S. Appl. No. 16/950,690, dated Feb. 16, 2023 12 pages.
Intention to Grant for European Patent Application No. 18883031.9, dated Jun. 30, 2023 57 pages.
Official Action for U.S. Appl. No. 17/967,141, dated Sep. 26, 2023 7 pages.

* cited by examiner

LIQUID COOLING OF A SCROLL TYPE COMPRESSOR WITH LIQUID SUPPLY THROUGH THE CRANKSHAFT

CROSS-REFERENCE TO RELATED APPLICATIONS

This application claims the benefit of U.S. Provisional Patent Application No. 63/119,399, filed Nov. 30, 2020 and entitled "LIQUID COOLING OF A SCROLL TYPE COMPRESSOR WITH LIQUID SUPPLY THROUGH THE CRANKSHAFT," the entirety of which is hereby incorporated by reference herein for all purposes.

FIELD

The present disclosure relates to scroll devices such as compressors, expanders, or vacuum pumps, and more particularly to scroll devices with liquid cooling.

BACKGROUND

Scroll devices have been used as compressors, expanders, pumps, and vacuum pumps for many years. In general, they have been limited to a single stage of compression (or expansion) due to the complexity of two or more stages. In a single stage scroll vacuum pump, a spiral involute or scroll orbits within a fixed spiral or scroll upon a stationery plate. A motor turns a shaft that causes the orbiting scroll to orbit eccentrically within the fixed scroll. The eccentric orbit forces a gas through and out of pockets created between the orbiting scroll and the fixed scroll, thus creating a vacuum in a container in fluid communication with the scroll device. An expander operates with the same principle, but with expanding gas causing the orbiting scroll to orbit in reverse and, in some embodiments, to drive a generator. When referring to compressors, it is understood that a vacuum pump can be substituted for a compressor and that an expander can be an alternate usage when the scrolls operate in reverse from an expanding gas.

Scroll type compressors and vacuum pumps generate heat as part of the compression or pumping process. The higher the pressure ratio, the higher the temperature of the compressed fluid. In order to keep the compressor hardware to a reasonable temperature, the compressor must be cooled or damage to the hardware may occur. In some cases, cooling is accomplished by blowing cool ambient air over the compressor components. On the other hand, scroll type expanders experience a drop in temperature due to the expansion of the working fluid, which reduces overall power output. As a result, scroll type expanders may be insulated to limit the temperature drop and corresponding decrease in power output.

SUMMARY

Existing scroll devices suffer from various drawbacks. In some cases, such as in tight installations or where there is too much heat to be dissipated, air cooling of a scroll device may not be effective. In semi-hermetic or hermetic applications, air cooling of a scroll device may not be an option. The use of a liquid to cool a scroll device may be beneficial because liquid has a much higher heat transfer coefficient than air. In the case of scroll expanders, the use of a liquid to heat the scroll expander may be beneficial for the same reason.

Embodiments of the present disclosure include a crankshaft with one or more channels extending through the crankshaft to transport a liquid for cooling and temperature regulation purposes. The crankshaft can include two channels generally extending through the crankshaft parallel to a longitudinal axis of the crankshaft. Liquid can flow through the one channel in one direction and the other channel in the other direction to circulate liquid through the crankshaft and to other components. Each end of the crankshaft can include multiple seals to segregate the liquid flowing in and out of each channel, respectively, into separate volumes. In some embodiments, one channel is aligned with a longitudinal axis or centerline of the crankshaft and one channel is offset from the longitudinal axis or centerline. The offset channel can transport liquid to the orbiting scroll, and the other channel can transport liquid away from the orbiting scroll.

One particular embodiment of the present disclosure is a scroll device comprising an orbiting scroll operably connected to a fixed scroll; a crankshaft operably connected to the orbiting scroll, wherein the crankshaft extends along a longitudinal axis between a first end and a second end; a first seal positioned about an outer surface of the crankshaft to form a seal with the outer surface; a second seal positioned about an outer surface of the crankshaft to form a seal with the outer surface, wherein a first volume is defined between the first seal and the second seal, and a second volume is at least partially defined by the second seal; a first channel extending through the crankshaft from the first end to the second end, and the first channel has an opening in fluid communication with the first volume; and a second channel extending through the crankshaft from the first end to the second end, and the second channel has an opening in fluid communication with the second volume.

In some embodiments, the scroll device further comprises one or more idler shafts through which a liquid can be transported to or from the orbiting scroll and at least one of the first channel and the second channel. In various embodiments, the scroll device further comprises one or more flexible tubes to transport a liquid to or from the orbiting scroll and at least one of the first channel and the second channel. In some embodiments, the scroll device further comprises a reservoir, and a liquid can flow through the crankshaft, an exit of the orbiting scroll, and into the reservoir.

In some embodiments, the first channel and the second channel are offset from a center axis of the crankshaft. In various embodiments, the crankshaft comprises a first protrusion and a second protrusion offset from the a center axis of the crankshaft and the first channel extends through the first protrusion and the second channel extends through the second protrusion. In some embodiments, the first seal and the second seal comprise a dynamic seal. In some embodiments, the first channel delivers cooling fluid to the orbiting scroll and the second channel carries cooling fluid away from the orbiting scroll. In various embodiments, the device further comprises one or more bearings configured to support the crankshaft.

In at least one embodiment of the present disclosure, a scroll device comprises an orbiting scroll operably connected to a fixed scroll; a crankshaft operably connected to the orbiting scroll, wherein the crankshaft extends along a longitudinal axis between a first end and a second end; at least one seal positioned about an outer surface of the crankshaft to form a seal with the outer surface; and at least one channel extending through the crankshaft from the first end to the second end, and the first channel has an opening in fluid communication with a fluid source, wherein fluid is supplied from the fluid source to the orbiting scroll via the at least one channel.

In some embodiments, the device further comprises a reservoir configured to receive a liquid from an exit of the orbiting scroll. In various embodiments, the at least one channel comprises a first channel and a second channel extending from the first end to the second end. In some embodiments, the first channel delivers cooling fluid to the orbiting scroll and the second channel carries cooling fluid away from the orbiting scroll. In some embodiments, the device further comprises one or more flexible conduits to transport a liquid to or from the orbiting scroll and at least one of the first channel and the second channel. In various embodiments, the device further comprises one or more idler shafts through which a liquid can be transported to or from the orbiting scroll and at least one of the first channel and the second channel. In some embodiments, the at least one channel is offset from a center axis of the crankshaft. In some embodiments, the crankshaft comprises a first protrusion and a second protrusion offset from a center axis of the crankshaft. In various embodiments, the at least one seal comprises a dynamic seal. In some embodiments, the device further comprises one or more bearings configured to support the crankshaft.

In at least one embodiment of the present disclosure, a scroll device comprises an orbiting scroll operably connected to a fixed scroll; a crankshaft operably connected to the orbiting scroll, wherein the crankshaft extends along a longitudinal axis between a first end and a second end; at least one first seal positioned about an outer surface of the crankshaft to form a seal with the outer surface; seal; a first channel extending through the crankshaft from the first end to the second end; and a second channel extending through the crankshaft from the first end to the second end, wherein the first channel and the second channel are offset from a center axis of the crankshaft, and wherein a cooling fluid travels in a first direction through the first channel and a second direction through the second channel to circulate the cooling fluid to and from the orbiting scroll.

The term "scroll device" as used herein refers to scroll compressors, scroll vacuum pumps, and similar mechanical devices. The term "scroll device" as used herein also encompasses scroll expanders, with the understanding that scroll expanders absorb heat rather than generating heat, such that the various aspects and elements described herein for cooling scroll devices other than scroll expanders may be used for heating scroll expanders (e.g., using warm liquid).

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_0$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_0$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Before any embodiments of the disclosure are explained in detail, it is to be understood that the disclosure is not limited in its application to the details of construction and the arrangement of components set forth in the following description or illustrated in the figures. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

Figure 1:
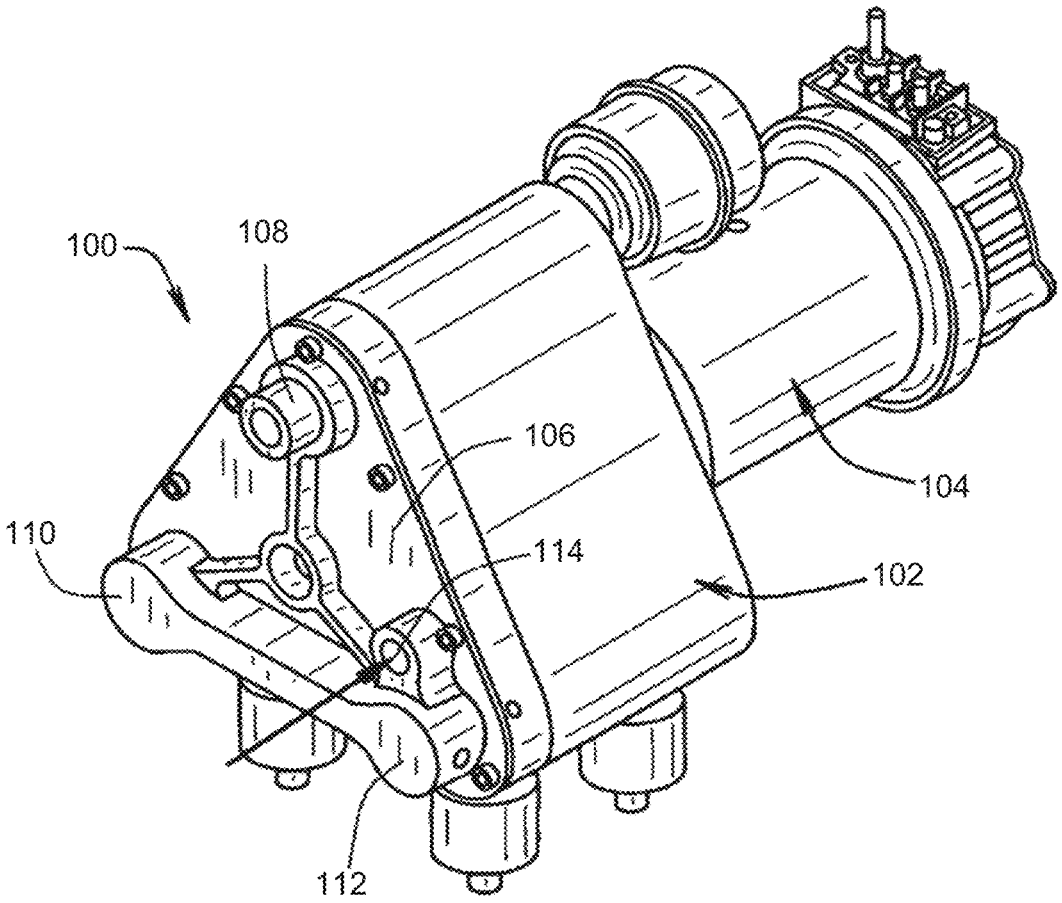
FIG. 1 is an isometric view of a scroll device according to at least one embodiment of the present disclosure.

Turning now to FIG. 1, a scroll device 100 according to embodiments of the present disclosure is shown. In the illustrated embodiment, the scroll device 100 comprises a housing 102 that is connected to a motor 104. The device 100 comprises a fixed scroll 106 having three idler shafts 108, 110, 112 being spaced approximately 120° apart. It will be appreciated that in some embodiments, the fixed scroll 106 may have more than or less than three idler shafts and the idler shafts may be spaced at any combination of angles. The fixed scroll 106 also has an inlet 114. The inlet 114 allows a cooling fluid such as, for example, a liquid (not shown) to be inserted into therein. Although not shown in detail in this particular view, it is known that the scroll device 100 has incorporated within the housing 102 components such as an orbiting scroll (such as an orbiting scroll 216 shown in FIG. 2) which is driven by a crankshaft (such as a crankshaft 240 shown in FIG. 2) connected to the motor 104. The motor 104 is used to drive the center shaft. In some embodiments, the motor 104 may be an electric motor. The crankshaft and the motor 104 are mounted in the housing 102.

The fixed scroll 106 is mated to the orbiting scroll. The orbiting scroll has a first involute and the fixed scroll 106 has a second involute. In order to balance the rotary motion of the orbiting scroll, a pair of balance weights may be positioned co-axially with the first involute to dynamically balance the orbiting scroll. Also, a pair of counterweights may be positioned on the crankshaft to dynamically balance the orbiting scroll. The orbiting scroll is coupled to the crankshaft that moves or orbits the orbiting scroll eccentrically, following a fixed path with respect to the fixed scroll 106, creating a series of crescent-shaped pockets between the two scrolls. In the case of a scroll compressor, the working fluid moves from the periphery (inlet) towards the center (discharge) through increasingly smaller pockets, generating compression. Similar principles apply for a scroll vacuum pump and a scroll expander. The idler shafts 108, 110, 112 are supported by the front bearings in the orbiting scroll and the rear bearings in the fixed scroll 106. A center line of the idler shaft is offset from a center line of the crankshaft. To seal any working fluid within the crankshaft, a labyrinth seal may be used. The labyrinth seal may be positioned between the bearings or after the rear bearing. It will be appreciated that in other embodiments any seal may be used to seal working fluid within the crankshaft.

Figure 2:
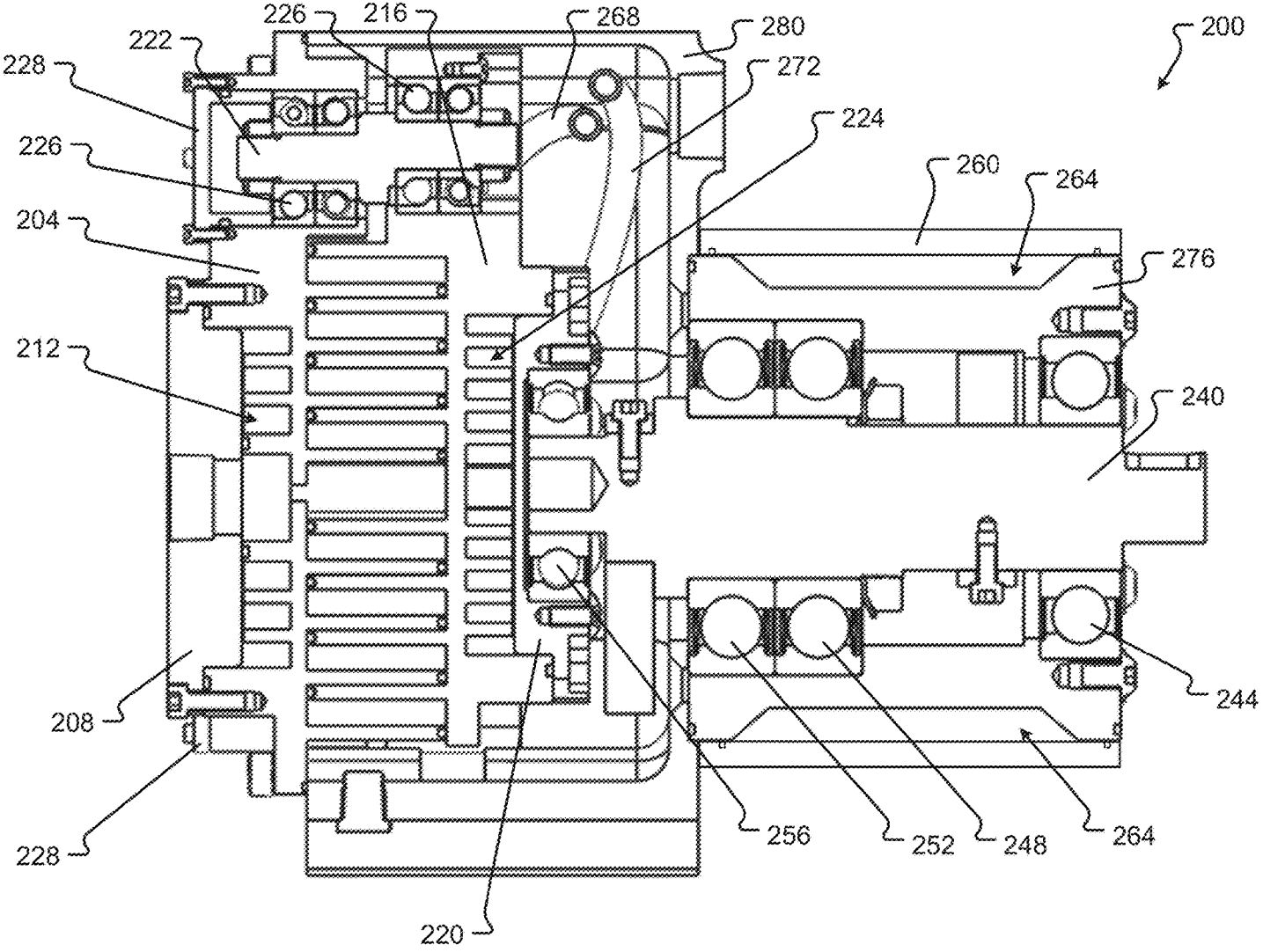
FIG. 2 is a cross-sectional view of a scroll device according to at least one embodiment of the present disclosure.

Turning now to FIG. 2, a cross-section view of a scroll device 200 according to embodiments of the present disclosure comprises many components that are the same as or substantially similar to the components of the scroll device 100 described herein. The scroll device 200 comprises a fixed scroll 204 and a fixed scroll jacket 208 defining a cooling chamber 212; an orbiting scroll 216 and an orbiting scroll jacket 220 defining a cooling chamber 224; a plurality of idler shaft assemblies 228, each comprising an idler shaft 222 supported by a plurality of bearings 226; flexible conduits 268 and 272 for routing coolant between or among two or more of the various cooling chambers of the scroll device 200, an external heat exchanger, and/or any other desired location; a crankshaft 240 for driving the orbiting scroll 216, the center drive shaft 240 supported by a crankshaft bearing 256 in the orbiting scroll jacket 220 as well as a plurality of crankshaft bearings 244, 248, 252 provided in a coupling 276 that extends between a drive motor of the scroll device 200 and a housing 280 of the scroll device 200; and a coupling jacket 260 attached to the coupling 276 and configured to define a cooling chamber 264 between the coupling 276 and the coupling jacket 260. It will be appreciated that in some embodiments, the device 200 may not include one or more components or may include additional components.

To prevent or reduce the likelihood of coolant leakage from one or more of the cooling chambers 212, 224, and 264, one or more O-rings or other seals or gaskets may be provided between the fixed scroll 204 and the fixed scroll jacket 208; between the orbiting scroll 216 and the orbiting scroll jacket 220; and/or between the coupling 276 and the coupling jacket 260.

As described elsewhere herein, the crankshaft 240 is operably connected (either directly or indirectly, e.g., by a belt or chain) at one end to a motor (e.g., a motor such as the motor 104 shown in FIG. 1), which drives the crankshaft 240. An opposite end of the crankshaft 240 engages the crankshaft bearing 256. The crankshaft 240 is eccentric, which allows the crankshaft 240 to drive the orbiting scroll 216 (via the crankshaft bearing 256 and the orbiting scroll jacket 220) in an orbiting motion relative to the fixed scroll 204.

Rotation of the crankshaft 240 causes rotation of the bearings 244, 248, and 252, which may result in the generation of a significant amount of heat. To cool the bearings 244, 248, and 252, coolant may be routed into and through the cooling chamber 264 defined by the coupling 276 and coupling jacket 260. Cooling the bearings 244, 248, and 252 in this way may beneficially increase the useful life of the bearings 244, 248, and 252 and reduce the likelihood of premature failure thereof.

Use of a coupling jacket 260 to form a cooling chamber 264 is not limited to the scroll device 200. Any of the scroll devices described herein may be modified to include a coupling jacket 260 and a cooling chamber 264, so as to enable cooling of bearings such as the bearings 244, 252, and 256.

Figure 3A:
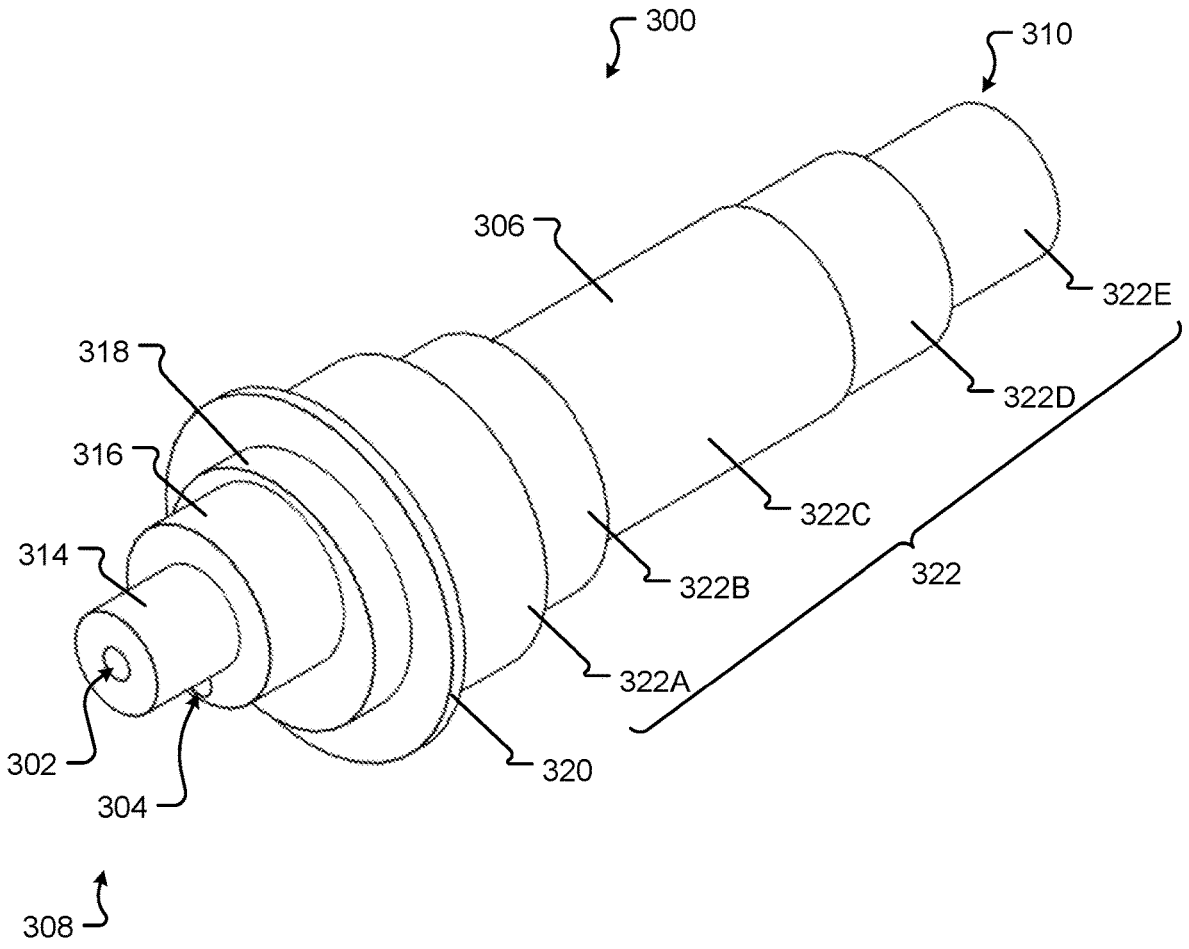
FIG. 3A is an isometric view of a crankshaft according to at least one embodiment of the present disclosure.

Turning to FIG. 3A, a crankshaft 300 according to at least one embodiment of the present disclosure is shown. The crankshaft 300 is configured to deliver cooling fluid (such as, for example, a liquid) to and from an orbiting scroll such as the orbiting scroll 216. The cooling fluid may be delivered via a first channel 302 and a second channel 304 (visible in FIGS. 3B-3D) as will be described in detail below. It will be appreciated that the crankshaft 300 can be used with any scroll device such as the scroll devices 100, 200.

Figure 3B:
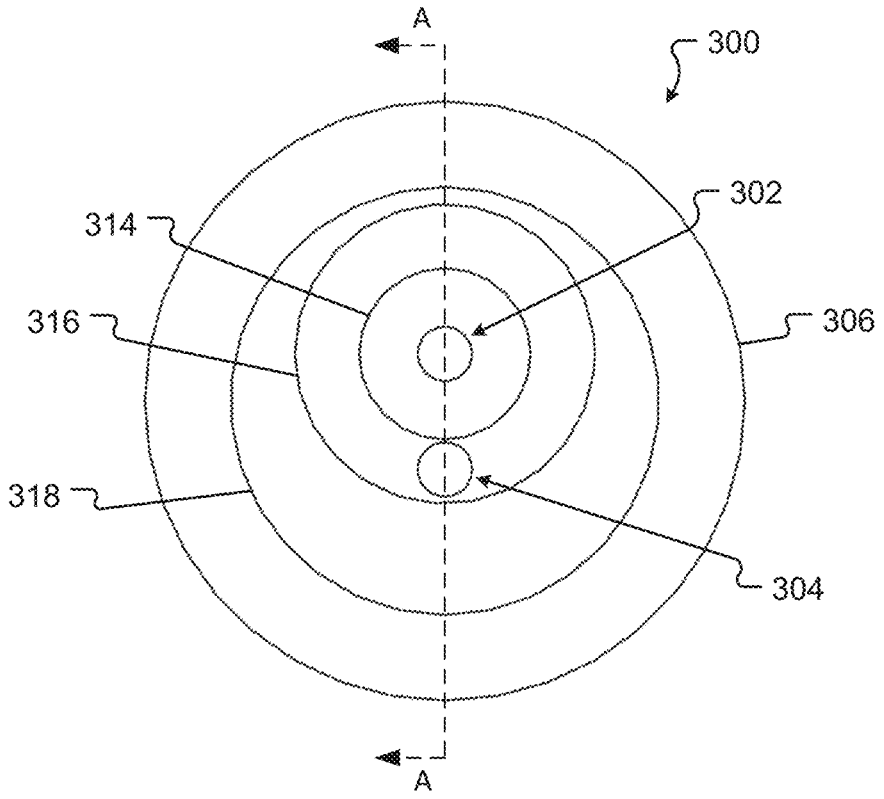
FIG. 3B is a front view of the crankshaft of FIG. 3A according to at least one embodiment of the present disclosure.
Figure 3C:
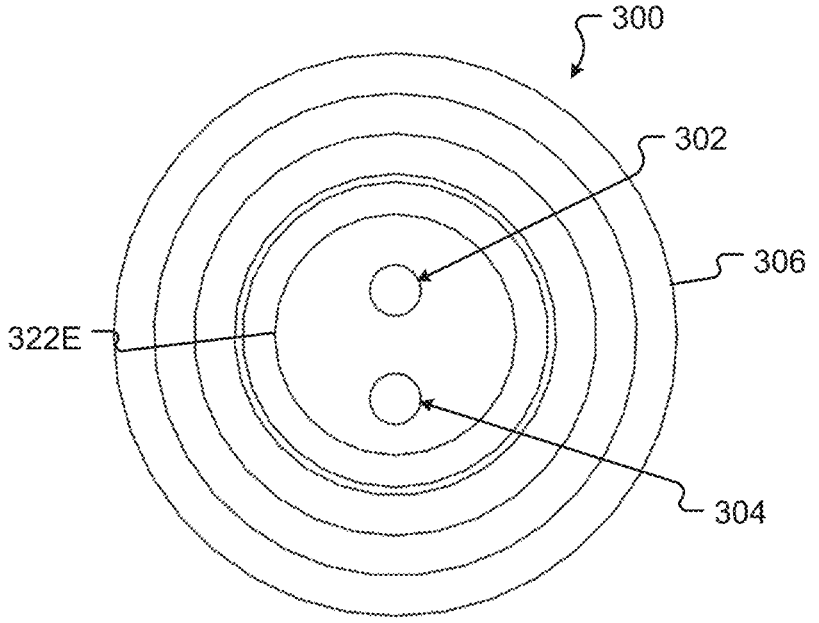
FIG. 3C is a rear view of the crankshaft of FIG. 3A according to at least one embodiment of the present disclosure.
Figure 3D:
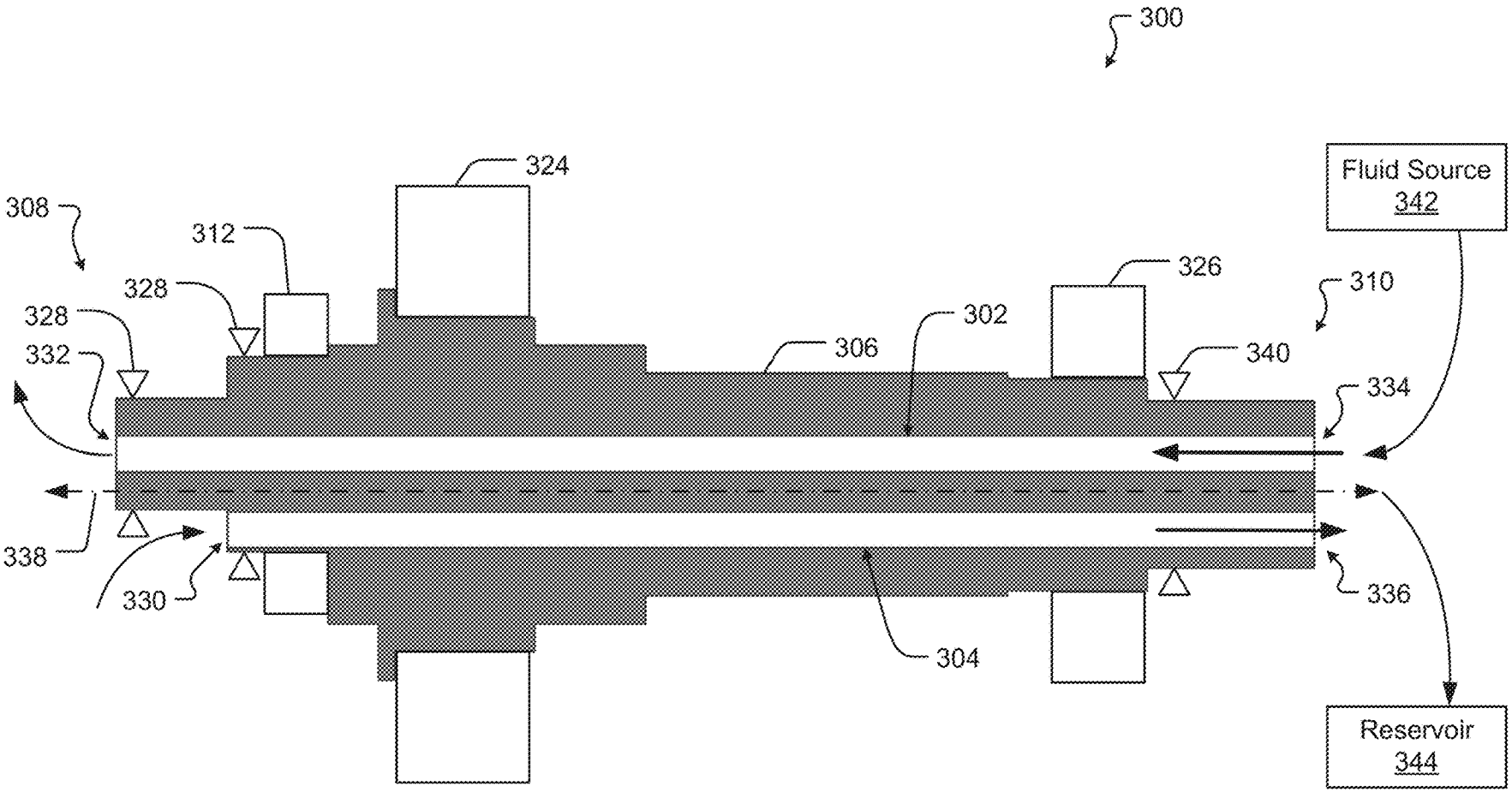
FIG. 3D is a cross-sectional view of the crankshaft of FIG. 3B along line A-A according to at least one embodiment of the present disclosure.

The crankshaft 300 comprises a body 306 extending from a first end 308 to a second end 310 along a longitudinal axis 338 (shown in FIG. 3D). As previously described, the first end 308 may be coupled to a crankshaft bearing such as the crankshaft bearing 256 or a crankshaft bearing such as the crankshaft bearing 312 (shown in FIG. 3D) and the second end 310 may be operably connected to a motor such as the motor 104 (either directly or indirectly, e.g., by a belt or chain) that drives the crankshaft 300. The crankshaft 300 also comprises a first protrusion 314 and a second protrusion 316 offset from a centerline of the body 306, a third protrusion 318 centered with the centerline of the body 306, and a flange 320. The first protrusion 314 and/or the second protrusion 316 may be formed eccentrically relative to the body 306. It will be appreciated that the crankshaft 300 may have one protrusion, two protrusions, or more than two protrusions and may have one flange, two flanges, or more than two flanges. As previously described, the crankshaft 300 is eccentric, and more specifically the first protrusion 314 and the second protrusion 316 are each offset and coupled to the crankshaft bearing 256 or the crankshaft bearing 312, which allows the crankshaft 300 to drive the orbiting scroll 216 in an orbiting motion relative to a fixed scroll such as the fixed scroll 204.

The crankshaft 300 also includes a plurality of steps 322 that each decrease in diameter from the flange 320 to the second end 310. It will be appreciated that in other embodiments, the plurality of steps 322 may increase in diameter from the flange 320 to the second end 310 or may have any combination of diameters. In the illustrated embodiment, the crankshaft 300 comprises a first step 322A, a second step 322B, a third step 322C, a fourth step 322D, and a fifth step 322E. It will be appreciated that in other embodiments the plurality of steps 322 may comprise any number of steps.

Turning to FIGS. 3B and 3C, a front view and a rear view of the crankshaft 300 are respectively shown. The crankshaft 300 comprises the first channel 302 and the second channel 304. As shown, the first channel 302 and the second channel 304 are offset from a centerline of the body 306. The first channel 302 and the second channel 304 may pass through the crankshaft 300 running parallel to one another. It will be appreciated that in some embodiments the first channel 302 and/or the second channel 304 may be centered relative to the body 306, the first protrusion 314, or the second protrusion 316. In the illustrated embodiment, the first channel 302 is aligned with the first protrusion 314 and the second channel 304 is aligned with the second protrusion 316. As shown in FIG. 3D, the first channel 302 and the second channel 304 extend from the first end 308 to the second end 310.

It will also be appreciated that in some embodiments, the crankshaft 300 may not include the second channel 304. In other embodiments, the crankshaft 300 may comprise more than two channels. In embodiments where the crankshaft 300 may comprise one channel (e.g., the first channel 302), the cooling fluid may be delivered to the orbiting scroll via the first channel 302 and may exit the orbiting scroll via, for example, an outlet to a reservoir, an idler shaft such as the idler shafts 108, 110, 112, and/or a flexible conduit such as the flexible conduits 268, 272. It will be appreciated that in some embodiments one or more of the idler shafts 108, 110, 112 may comprise a channel that passes through the idler shaft 108, 110, 112 for cooling fluid to pass therethrough. The channel may be the same as or similar to the first channel 302 and/or the second channel 304. Further, each idler shaft 108, 110, 112 may comprise one channel, two channels, or more than two channels.

Turning to FIG. 3D, a cross-sectional view of the crankshaft 300 taken from A-A in FIG. 3B is shown. Additionally, bearings and seals are shown. The crankshaft 300 is coupled to the crankshaft bearing 312 and is supported by a front bearing 324 and a rear bearing 326. In some embodiments, the front bearing 324 may comprise one, two, or more than two front bearings and the rear bearing 326 may comprise one, two, or more than two rear bearings. In the illustrated embodiment, the crankshaft bearing 312 is coupled to the second protrusion 316 so as to provide access to the second channel 304 so that the second channel 304 may be in fluid communication with the orbiting scroll 216. The crankshaft 300 also includes a first seal 328 at the first end 308 and a second seal 340 disposed at the second end 310 to seal the cooling fluid and prevent fluid from leaking into a housing such as the housing 280. For instance, the first seal 328 may be in circumferential contact with an outer diameter of the first protrusion 314 and/or the second protrusion 316 of the crankshaft 300. The second seal 340 may be in circumferential contact with an outer diameter of the fifth step 322E of the crankshaft 300. In the illustrated embodiment, two first seals 328 are positioned at the first end 308 and a second seal 340 is positioned at the second end 310. It will be appreciated that in other embodiments one, two, or more than two first and/or second seals may be positioned at the first end 308 and/or the second end 310.

The first seal 328 and the second seal 340 may be dynamic seals such as, for example, lip seals, face seals, bushings, floating bushings, and/or ferro seals. The first seal 328 and the second seal 340 may be formed from any material or any composite of materials. It is desirable to seal the liquid as any leakage may contaminate lubricant in the bearings (e.g., the crankshaft bearing 312, the front bearing 324, the rear bearing 326, and/or any other bearing).

As shown in the illustrated embodiment, a first inlet or opening 330 and a first outlet or opening 332 are positioned at the first end 308 and a second inlet or opening 334 and a second outlet or opening 336 are positioned at the second end 310. The first inlet 330 and the first outlet 332 may be in fluid communication with the orbiting scroll 216. In some embodiments, the two first seals 328 are positioned at the first end 308 such that a first volume is defined by at least one of the first seals 328 at the first outlet 332 and a second volume is defined by the two first seals 328 at the first inlet 330. In such embodiments, the first channel 302 may be in fluid communication with the first volume and the second channel 304 may be in fluid communication with the second volume. It will be appreciated that in some embodiments a first volume and a second volume may be defined by two second seals 340 at the second end 310.

The second inlet 334 and the second outlet 336 may be in fluid communication with a fluid source 342 and a fluid reservoir 344, respectively. In some embodiments, the fluid source 342 and the fluid reservoir 344 may be the same component. In other embodiments, the fluid source 342 and the fluid reservoir 344 may be separate components.

Cooling fluid may flow in a first direction in one of the first channel 302 or the second channel 304 and flow in a second direction in another one of the first channel 302 or the second channel 304 to circulate a cooling fluid to one or more components such as, for example, the orbiting scroll 216. More specifically in some embodiments, the first outlet 332 delivers cooling liquid from the second inlet 334 to the orbiting scroll 216 via the first channel 302 and the first inlet 330 receives cooling liquid from the orbiting scroll 216 and delivers the cooling liquid to the second outlet 336 via the second channel 304. Thus, cooling liquid is easily and simply delivered to and from the orbiting scroll through the crankshaft 300. The crankshaft 300 may reduce a number of components for cooling a scroll device such as the devices 100, 200, or provide supportive cooling to additional cooling components or act as a primary cooling mechanism.

Figure 3E:
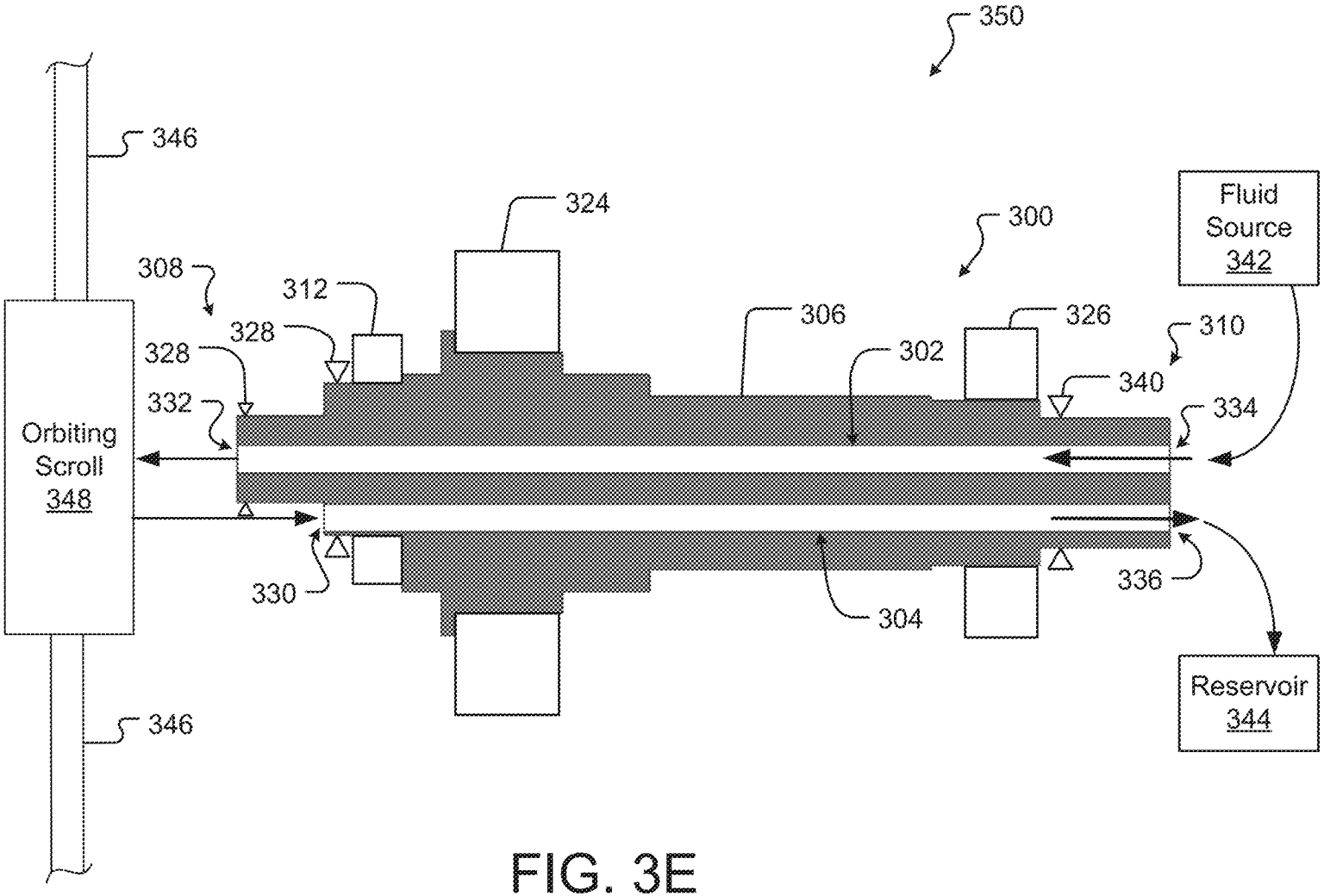
FIG. 3E is a cross-sectional view of the crankshaft of FIG. 3B along line A-A and one or more flexible conduits according to at least one embodiment of the present disclosure.

Turning to FIG. 3E, a cross-sectional view of the crankshaft 300 and a schematic view of an orbiting scroll 348 of a scroll device 350 is shown. The orbiting scroll 348 may be the same as or similar to the orbiting scroll 216. Additionally, a pair of flexible conduits 346 are also shown. The pair of flexible conduits 346 may be the same as or similar to the flexible conduits 268, 272. In some embodiments, the crankshaft 300 may deliver fluid to the orbiting scroll 348 via the first outlet 332 of the crankshaft 300. The fluid may travel through the orbiting scroll 348 (or a cooling jacket of the orbiting scroll 348) and exit from one of the flexible conduits 348. The fluid may travel through the flexible conduit 348 to one or more components (e.g., a fixed scroll, a cooling jacket, a fluid reservoir, etc.) then back to the orbiting scroll 348 via another one of the pair of flexible conduits 346. In some embodiments, the fluid may simply be routed to a reservoir such as the reservoir 344. In other embodiments, the fluid may exit the orbiting scroll 348 via the first inlet 330 of the crankshaft 300. It will be appreciated that in some embodiments, the device 350 may comprise one flexible conduit or more than two flexible conduits.

It will be appreciated that cooling fluid may be delivered to the orbiting scroll 216, 348 using any combination of delivery mechanisms and/or components. In will also be appreciated that a cooling loop may be open or closed. In other words, in some embodiments, the cooling loop may be self-contained, whereas in other embodiments, the cooling loop may comprise an separate cooling source and/or reservoir for receiving spent cooling fluid. In some embodiments, cooling fluid may be delivered to and from the orbiting scroll 216, 348 using the crankshaft 300. In such embodiments, the scroll device may not include, for example, flexible conduits. In other embodiments, cooling fluid may be delivered to the orbiting scroll 216, 348 using the crankshaft 300 and one or more idler shafts 108, 110, 112. Further background, context, and description of the idler shafts 108, 110, 112 can be found in U.S. Pat. No. 10,865,793, the entirety of which is hereby incorporated by reference herein for all purposes. In other embodiments, cooling fluid may be delivered to the orbiting scroll 216, 348 using the crankshaft 300 and flexible conduits 268, 272. Further background, context, and description of the flexible conduits 268, 272, 346 can be found in U.S. Patent Publication No. 2020/0408201, the entirety of which is hereby incorporated by reference herein for all purposes. In still other embodiments, cooling fluid may be delivered to and from the orbiting scroll 216, 348 via the crankshaft 300, one or more idler shafts 108, 110, 112, and/or the flexible conduits 268, 272, 346. In still other embodiments, cooling fluid may be delivered to the orbiting scroll 216, 348 using the crankshaft 300 and may exit the orbiting scroll 216, 348 into a reservoir.

Ranges have been discussed and used within the forgoing description. One skilled in the art would understand that any sub-range within the stated range would be suitable, as would any number or value within the broad range, without deviating from the invention. Additionally, where the meaning of the term "about" as used herein would not otherwise be apparent to one of ordinary skill in the art, the term "about" should be interpreted as meaning within plus or minus five percent of the stated value.

Throughout the present disclosure, various embodiments have been disclosed. Components described in connection with one embodiment are the same as or similar to like-numbered components described in connection with another embodiment.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Any of the steps, functions, and operations discussed herein can be performed continuously and automatically.

What is claimed is:

1. A scroll device comprising:

an orbiting scroll operably connected to a fixed scroll;

a crankshaft operably connected to the orbiting scroll, wherein the crankshaft extends a total length along a longitudinal axis from a first end of the crankshaft to a second end of the crankshaft, and wherein the first end is arranged opposite the second end;

a first seal positioned about a first circumferential portion of an outer surface of the crankshaft to form a seal with the first circumferential portion;

a second seal positioned about a second circumferential portion of the outer surface of the crankshaft to form a seal with the second circumferential portion, wherein a first volume is at least partially defined by the first seal, and wherein a second volume is defined between the first seal and the second seal;

a first channel extending along a first channel axis completely through the crankshaft from a first opening disposed in a first portion of the first end to a second opening disposed in a first portion of the second end, wherein the first opening and the second opening are arranged in a line coincident with the first channel axis, wherein the first channel axis is parallel to the longitudinal axis, and wherein the first opening is in fluid communication with the first volume; and a second channel extending along a second channel axis completely through the crankshaft from a third opening disposed in a second portion of the first end to a fourth opening disposed in a second portion of the second end, wherein the third opening and the fourth opening are arranged in a line coincident with the second channel axis, wherein the third opening is disposed within a periphery of the first end, wherein an entirety of the second channel axis is parallel to an entirety of the first channel axis, and wherein the third opening is in fluid communication with the second volume.

2. The scroll device of claim 1, further comprising one or more idler shafts through which a cooling fluid can be transported to or from the orbiting scroll and at least one of the first channel and the second channel.

3. The scroll device of claim 1, further comprising one or more flexible conduits to transport a cooling fluid to or from the orbiting scroll and at least one of the first channel and the second channel.

4. The scroll device of claim 1, further comprising a reservoir configured to receive a cooling fluid from an exit of the orbiting scroll.

5. The scroll device of claim 1, wherein the first channel and the second channel are offset from the longitudinal axis of the crankshaft.

6. The scroll device of claim 1, wherein the crankshaft comprises a first protrusion and a second protrusion offset from the longitudinal axis of the crankshaft and the first channel extends through the first protrusion and the second channel extends through the second protrusion.

7. The scroll device of claim 1, wherein the first seal and the second seal comprise a dynamic seal.

8. The scroll device of claim 1, wherein the first channel delivers cooling fluid to the orbiting scroll and the second channel carries cooling fluid away from the orbiting scroll.

9. The scroll device of claim 1, further comprising one or more bearings configured to support the crankshaft.

10. A scroll device comprising:

an orbiting scroll operably connected to a fixed scroll;

a crankshaft operably connected to the orbiting scroll, wherein the crankshaft extends a total length along a longitudinal axis from a first end of the crankshaft to a second end of the crankshaft, and wherein the first end is arranged opposite the second end;

at least one seal positioned about an outer surface of the crankshaft to form a seal with the outer surface;

a first channel extending along a first channel axis completely through the crankshaft from a first opening disposed in a first portion of the first end to a second opening disposed in a first portion of the second end, wherein the first opening and the second opening are arrange in a line coincident with the first channel axis, wherein the first opening is in fluid communication with a first fluid source, wherein the first opening is disposed within a periphery of the first end, and wherein the first channel axis is parallel to the longitudinal axis; and a second channel extending along a second channel axis completely through the crankshaft from a third opening disposed on a second portion of the first end to a fourth opening disposed in a second portion of the second end, wherein the third opening and the fourth opening are arranged in a line coincident with the second channel axis, wherein the third opening is in fluid communication with a second fluid source, wherein the third opening is disposed within the periphery of the first end, and wherein an entirety of the second channel axis is parallel to an entirety of the first channel axis.

11. The scroll device of claim 10, further comprising a reservoir configured to receive a liquid from an exit of the orbiting scroll.

12. The scroll device of claim 10, wherein cooling fluid is supplied from at least one of the first fluid source or the second fluid source to the orbiting scroll via at least one of the first channel and the second channel.

13. The scroll device of claim 12, wherein the first channel delivers cooling fluid as incoming cooling fluid to the orbiting scroll and the second channel carries the cooling fluid as outgoing cooling fluid away from the orbiting scroll.

14. The scroll device of claim 10, further comprising one or more flexible conduits to transport a liquid to or from the orbiting scroll and at least one of the first channel and the second channel.

15. The scroll device of claim 10, further comprising one or more idler shafts through which a liquid can be transported to or from the orbiting scroll and at least one of the first channel and the second channel.

16. The scroll device of claim 10, wherein the first channel and the second channel are offset from the longitudinal axis of the crankshaft.

17. The scroll device of claim 10, wherein the crankshaft comprises a first protrusion and a second protrusion offset from the longitudinal axis of the crankshaft.

18. The scroll device of claim 10, wherein the at least one seal comprises a dynamic seal.

19. The scroll device of claim 10, further comprising one or more bearings configured to support the crankshaft.

20. A scroll device comprising:

an orbiting scroll operably connected to a fixed scroll;

a crankshaft operably connected to the orbiting scroll, wherein the crankshaft extends a total length along a longitudinal axis between a first end of the crankshaft to a second end of the crankshaft, and wherein the first end is arranged opposite the second end;

at least one first seal positioned about an outer surface of the crankshaft to form a seal with the outer surface;

a first channel extending along a first channel axis completely through the crankshaft from a first opening disposed in a first portion of the first end to a second opening disposed in a first portion of the second end, wherein the first opening and the second opening are arranged in a line coincident with the first channel axis, wherein the first opening is disposed within a periphery of the first end, and wherein the first channel axis is parallel to the longitudinal axis; and a second channel extending along a second channel axis completely through the crankshaft from a third opening disposed in a second portion of the first end to a fourth opening disposed in a second portion of the second end, wherein the third opening and the fourth opening are arranged in a line coincident with the second channel axis, wherein the third opening is disposed within the periphery of the first end, and wherein the second channel axis is parallel to the first channel axis, wherein the first channel and the second channel are offset from the longitudinal axis of the crankshaft, and wherein a cooling fluid travels in a first direction through the first channel and in a second direction through the second channel to circulate the cooling fluid to and from the orbiting scroll.

* * * * *